US007341484B2

(12) United States Patent
Yamamoto

(10) Patent No.: US 7,341,484 B2
(45) Date of Patent: Mar. 11, 2008

(54) CONTROL PANEL CIRCUIT COUPLER WITH ELASTIC SEALING MEMBER

(75) Inventor: Takao Yamamoto, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/654,630

(22) Filed: Jan. 18, 2007

(65) Prior Publication Data

US 2007/0190850 A1 Aug. 16, 2007

(30) Foreign Application Priority Data

Jan. 20, 2006 (JP) ..... 2006-012407

(51) Int. Cl.
*H01R 13/40* (2006.01)

(52) U.S. Cl. ..... 439/587; 439/271

(58) Field of Classification Search ..... 439/587, 439/517, 519, 521, 271
See application file for complete search history.

(56) References Cited

U.S. PATENT DOCUMENTS 4,726,788 A * 2/1988 F'Geppert ..... 439/551
4,842,540 A * 6/1989 Endo et al. ..... 439/271
5,139,431 A * 8/1992 Saitoh et al. ..... 439/364
6,280,237 B1 * 8/2001 Saka et al. ..... 439/489
6,398,585 B1 * 6/2002 Fukuda ..... 439/587
6,475,008 B1 * 11/2002 Marolda et al. ..... 439/271
6,835,094 B2 * 12/2004 Matsushita ..... 439/559
7,033,216 B2 * 4/2006 Ito ..... 439/587
7,255,585 B2 * 8/2007 Kameyama et al. ..... 439/271
2005/0037651 A1 * 2/2005 Axenbock et al. ..... 439/271
2005/0106916 A1 * 5/2005 Nomura ..... 439/275

FOREIGN PATENT DOCUMENTS

JP 08-142709 6/1996

* cited by examiner

*Primary Examiner*—Tho D. Ta
*Assistant Examiner*—Vanessa Girardi
(74) *Attorney, Agent, or Firm*—Birch, Stewart, Kolasch & Birch, LLP

(57) ABSTRACT

A coupler which is fixed to a meter case (lower case) includes a sleeve which penetrates the case, and a flange which overhangs from the sleeve to a circumference thereof. An annular groove holding a seal ring is provided in the flange. A step as a mark is provided on an outer circumference of the sleeve in order that an adequate compression amount of the seal ring can be recognized from the external appearance. This step is aligned with an outer surface of the lower case when the seal ring is compressed up to the adequate compression amount. This configuration makes it possible to easily recognize, from an external appearance, whether or not a waterproof tight-sealing level of a coupler penetrating a meter case is adequate.

20 Claims, 8 Drawing Sheets

CONTROL PANEL CIRCUIT COUPLER WITH ELASTIC SEALING MEMBER

CROSS-REFERENCE TO RELATED APPLICATION

The present application claims priority under 35 U.S.C. §119 to Japanese Patent Application No. 2006-012407, filed Jan. 20, 2006, the entire contents of which are hereby incorporated by reference.

BACKGROUND OF THE INVENTION

1. Field of the Invention

The present invention relates to a control panel apparatus. Particularly, the present invention relates to a control panel apparatus suitable for a meter for vehicle, whose waterproof performance is enhanced.

2. Description of Background Art

A vehicle is provided with a speedometer, an engine speed meter and the like, and these meters are mounted on the vehicle, the meters being housed in a meter box. Japanese Patent Application Laid-open Official Gazette No. Hei 8-142709 describes a waterproof meter for vehicle, which is constituted in the following manner that: a flexible printed circuit board (FPC) which is disposed on a backside of a meter box, and which is for transmitting an electric signal, is covered with a lower cover (a backside cover); an intermediate connector, which has terminals for transmitting an electric signal from the vehicle to the FPC, is provided; and a flange portion of this intermediate connector overlaps the lower cover.

A mounting hole is formed in the lower cover of the meter for vehicle described in Japanese Patent Application Official Gazette Laid-open No. Hei 8-142709. The intermediate connector penetrates through the mounting hole so that the intermediate connector would be projectable to the outside. A sealing member is generally used between such a mounting hole and the lower cover, for the purpose of ensuring waterproof performance. However, favorable sealing performance cannot be expected unless the sealing member securely adheres to a sealed member. Although the clamping by a screw is usually performed for the purpose of causing the sealing member to securely adhere to the sealed member, it is not easy to obtain an adequate clamping force of the screw. However, there has not been easy conventional means, other than the one using a tool or the like having a torque limitation, by which an adequate clamping force can be judged with a sense of an individual worker.

SUMMARY AND OBJECTS OF THE INVENTION

An object of the present invention is to provide a control panel apparatus capable of enhancing sealing performance of a pierced mounting hole which is provided in a cabinet for the purpose of allowing a coupler to project from the cabinet to the outside.

The present invention for achieving the aforementioned object includes: a cabinet and a coupler, the cabinet housing an electric circuit, the coupler being for connecting electric wiring from the outside to the electric circuit, the coupler being composed of a sleeve and a flange, the sleeve penetrating a mounting hole provided in the cabinet, the flange overhanging from the sleeve in a direction along an outer circumference thereof.

According to a first aspect of the present invention, an elastic sealing member is arranged between the flange and an inner surface of the cabinet; fastening means for press the flange against the inner surface of the cabinet; and a mark is added to an outer circumferential surface of the sleeve so as to be aligned with the same plane as an outer surface of the cabinet in a part thereof corresponding to the mounting hole, in a state where the flange has been pressed until a compression amount of the elastic sealing member becomes an intended adequate value.

Additionally, according to a second aspect of the present invention, an annular groove is formed in the flange, the annular groove holding the elastic sealing member in the flange.

Additionally, according to a third aspect of the present invention, an annular member erected adjacently to an outer circumference of the flange of the sleeve, on the inner surface of the cabinet.

Furthermore, according to a fourth aspect of the present invention, the mark is a step formed on the outer circumferential surface of the sleeve by varying a thickness of the sleeve.

Additionally, according to a fifth aspect of the present invention, a control panel apparatus configured as a meter for vehicle.

Effects of the Invention

According to the first aspect of the present invention, in a case of obtaining a predetermined tight-sealing level by compressing the elastic sealing member by the fastening means constituted, for example, of a screw, whether or not the elastic sealing member has been compressed to obtain the predetermined tight-sealing level can be judged based on whether or not the mark is aligned with the outer surface of the cabinet. Accordingly, when the coupler is fixed to the cabinet, a clamping degree of the screw can be objectively and easily judged, whereby efficiency of the work can be enhanced, and a consistent tight-sealing level can be invariably fixed by different workers.

According to the second aspect of the present invention, the coupler can be combined with the cabinet in a state where the elastic sealing member is held on the coupler, whereby efficiency of the work can be enhanced.

According to the third aspect of the present invention, a portion of the cabinet around the coupler to which the electric wiring from the vehicle side is connected can be reinforced, and also, even if the tight-sealing level of the elastic sealing member is decreased, the annular member can prevent moisture having infiltrated into the cabinet from immediately entering a vicinity of the circuit.

According to the fourth aspect of the present invention, it is possible to recognize that the predetermined tight-sealing level has been obtained, with the fact that the step, which is formed on a surface of the sleeve, and the outer surface of the cabinet have been aligned with each other.

According to the fifth aspect of the present invention, for example, it is possible to enhance waterproof performance and dustproof performance of a meter in a vehicle, such as an all-terrain vehicle, used in a severe external environment.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 6:
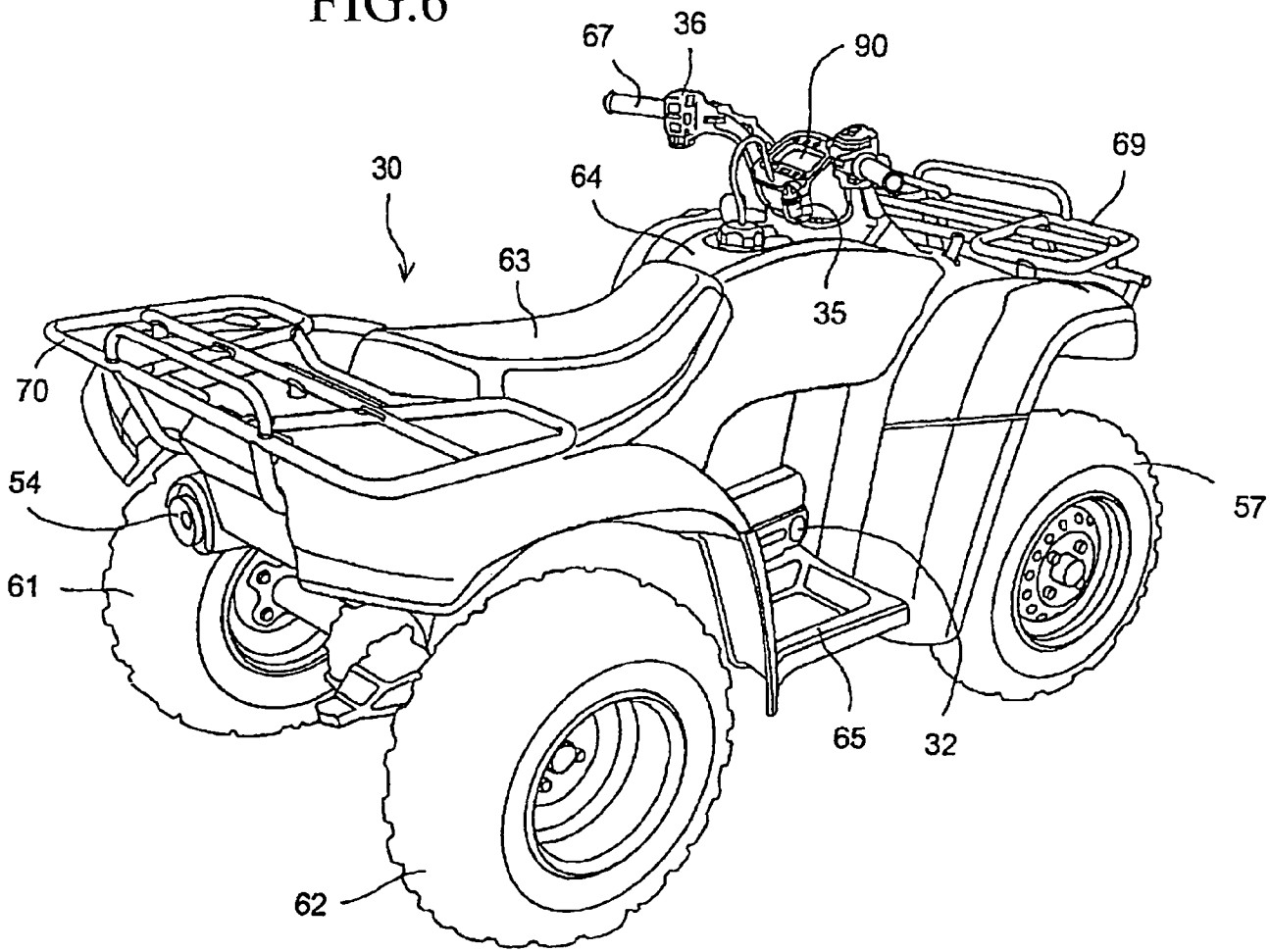
FIG. 6 is a perspective view of a vehicle seen from right rear, the vehicle including the meter for vehicle, which is an example of a control panel apparatus according to the embodiment of the present invention.
Figure 7:
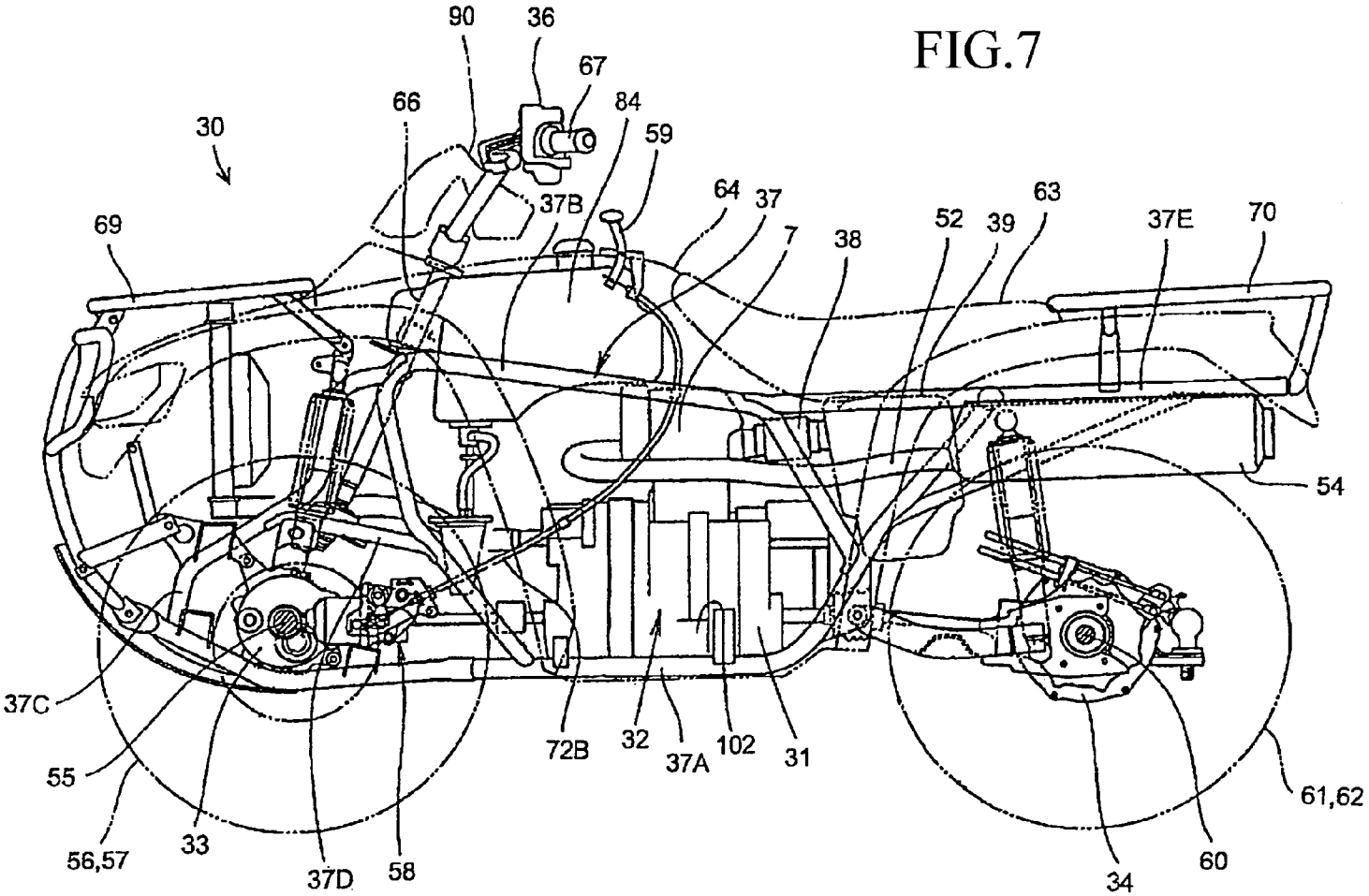
FIG. 7 is a left side view of the same vehicle.

One embodiment of the present inventions will be described below with reference to the drawings. FIG. 6 is a perspective view of a vehicle seen from right rear, the vehicle including a meter for vehicle, which is an example of a control panel apparatus according to the embodiment of the present invention, and FIG. 7 is a left side view of the same vehicle. A vehicle 30 is an all-terrain vehicle (ATV) of a four wheel drive. Substantially at the center of the vehicle 30, a power unit 32, which includes a transmission 31 and an engine E, is arranged by being longitudinally placed. The power unit 32 is connected to a front final assembly 33 arranged in a front part, and to a rear final assembly 34 arranged in a rear part, so as to be able to transmit an output from the engine thereto.

A vehicle body frame 37 includes: a pair of left and right lower frames 37A which support a lower part of the power unit 32; an upper frame 37B mounted on upper parts of the lower frames 37A in a way that the upper frame 37B surrounds the power unit 32 in a side view of the vehicle; a pair of left and right front frames 37C coupling a front upper part of the upper frame 37B to front end parts of the respective lower frames 37A; a pair of left and right front coupling frames 37D coupling each of the front frames 37C to the upper frame 37B; and a pair of left and right rear upper frames 37E extended rearward from rear front part of the upper frame 37B and having intermediate parts thereof coupled to rear ends of the lower frames 37A.

An air cleaner 39 is connected to an intake side of the engine E through a throttle body 38, and an exhaust pipe 52 and a muffler 54 are included in an exhaust side of the engine E.

The front final assembly 33 is coupled to left and right front wheels 56 and 57 through a pair of left and right drive shafts 55. The front final assembly 33 has a drive switching unit 58, which interrupts a driving force transmitted from the power unit 32 to the front final assembly 33, annexed to a rear part thereof. Specifically, the drive switching unit 58 switches the vehicle 30 into rear wheel drive or into four wheel drive by making the front wheels 56 and 57 driven or undriven. By having an operation lever 59 operated, the drive switching unit 58 switches the front wheels 56 and 57 into a state being able to be driven. The rear final assembly 34 is coupled to left and right rear wheels 61 and 62 through a pair of left and right drive shafts 60.

A seat 63 for a driver is arranged in a part above the engine E, and a fuel tank 64 is provided in front of the seat 63. Steps 65 for a driver to place the legs on are included in lower parts at both sides of the engine E. In front of the fuel tank 64, a steering handle 67 is supported by a steering shaft 66 mounted on the vehicle body frame 37. A meter panel 90 is arranged at the center of the steering handle 67. An ignition switch 35, which will be described later in detail, is provided to a side part of the meter panel 90. In a vicinity of a left grip of the steering handle 67, a combination switch 36, which includes an operation switch of the transmission 31, a status switch, an engine stop switch, a lighting switch, a dimmer switch and the like, is provided.

A front carrier 69 is provided to a front part of the vehicle, and a rear carrier 70 is provided to a rear part of the vehicle.

Figure 2:
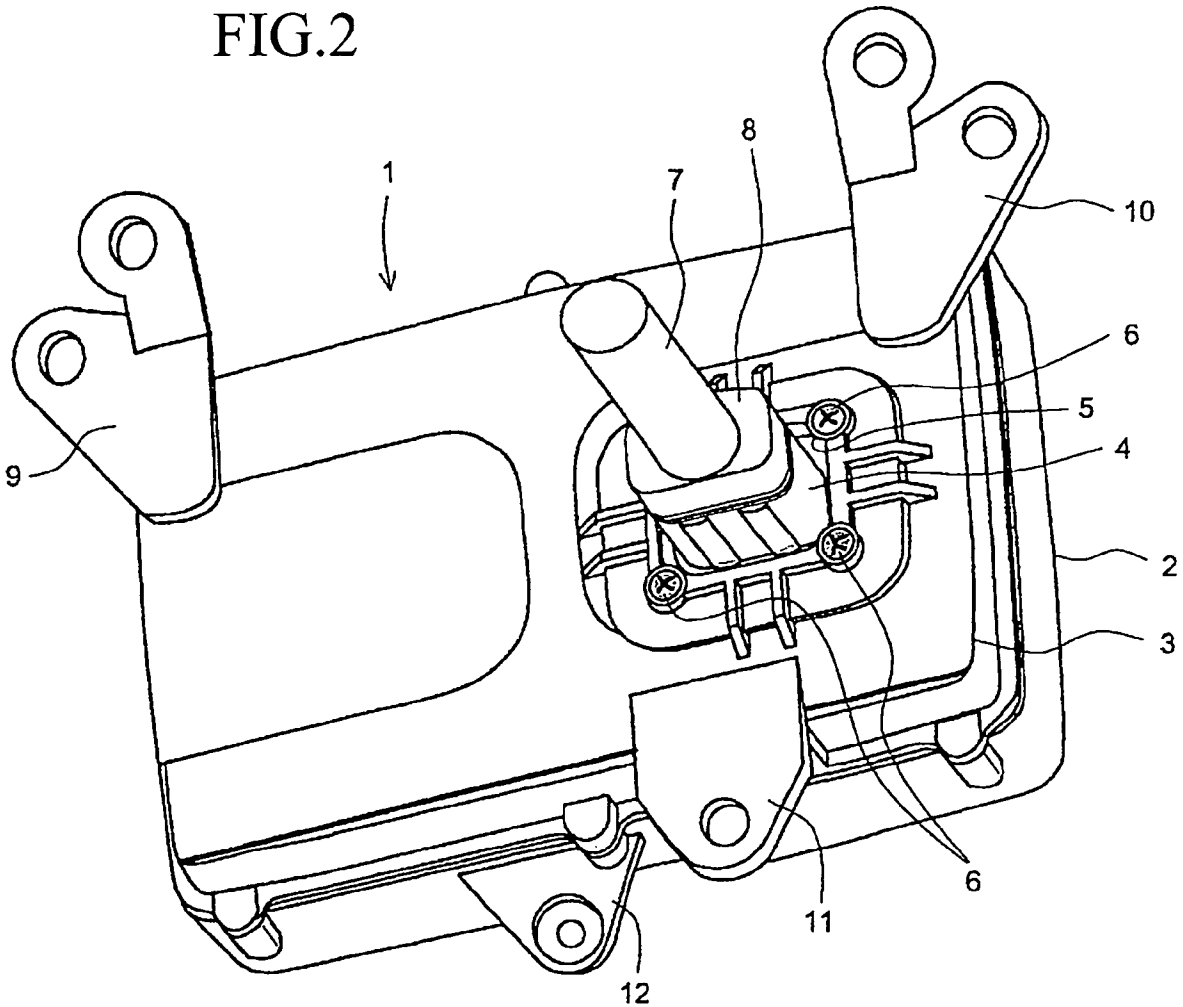
FIG. 2 is a perspective view of the meter for vehicle according to the embodiment of the present invention.

FIG. 2 is a backside perspective view of a meter box 1 mounted on a vehicle, such as the aforementioned ATV, which demands high waterproof and dustproof performance. The meter box 1 is composed of an upper (front surface side) case 2 and a lower (back surface side) case 3. The meter box 1 houses a board 15 (described later) on which to provide LEDs and a LED display circuit. The LEDs digitally display, for example, a speed of the vehicle, a gear position, a remaining amount of fuel and the like. The lower case 3 has a mounting hole 5 which is formed so as to allow a coupler (male coupler) 4 to penetrate therethrough. The male coupler 4 connects an electric signal, which is supplied from the vehicle through an electric wiring, i.e., a harness 7, to the LED display circuit on the board housed in the upper box 2. The male coupler 4 is joined with a female coupler 8 connected to the harness 7 extended from the vehicle side. The male coupler 4 is fixed to the lower case 3 by means of four fastening screws 6 (one of which is not illustrated) inserted from an outside of the lower case 3. A mounting structure of the male coupler 4 will be further described later.

A first stay 9, a second 10 and a third stay 11 are provided to the lower case 3, and a fourth stay 12 is provided to the upper case 2. These stays 9 to 12 are formed integrally with the lower case 3 and the upper case 2. The meter box 1 is fixed by attaching the first to fourth stays 9 to 12 to the vehicle frame by use of bolts or the like.

Figure 1:
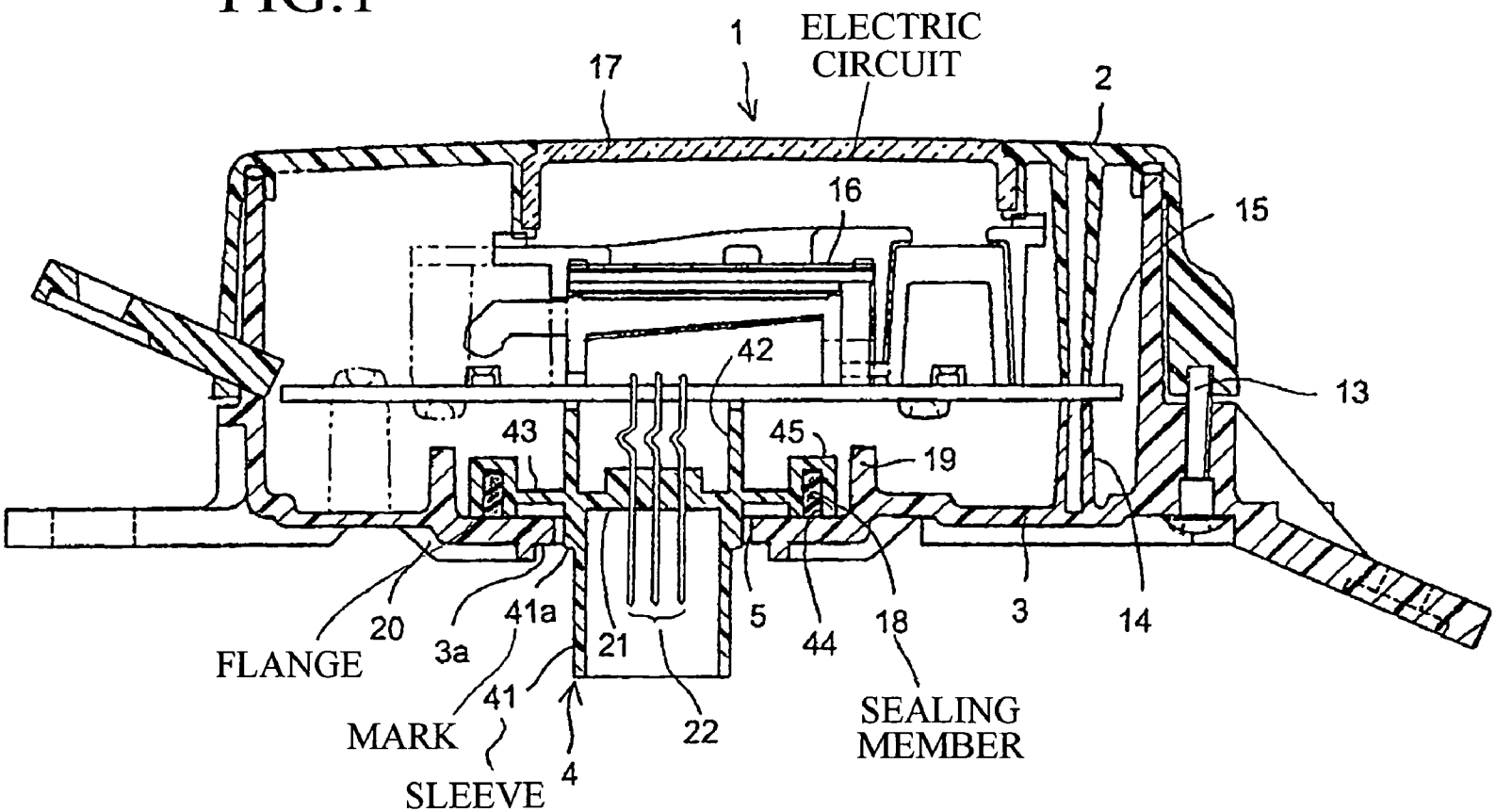
FIG. 1 is a cross sectional view of a meter for vehicle according to one embodiment of the present invention.
Figure 8:
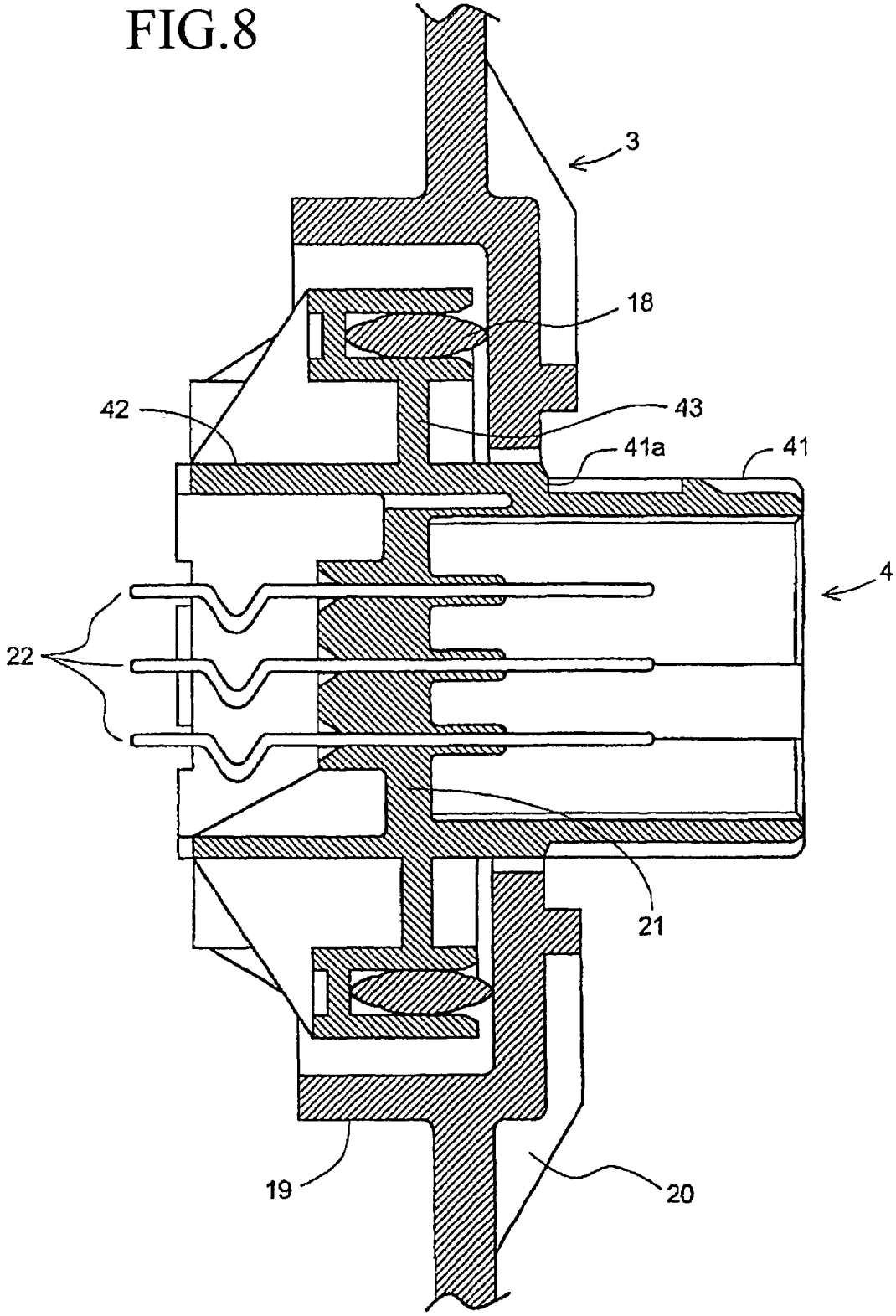
FIG. 8 is an enlarged view of a main part of FIG. 1.

Next, the mounting structure of the male coupler 4 will be described. FIG. 1 is a cross sectional view of the box 1, and FIG. 8 is an enlarged view of a main part of FIG. 1. In FIGS. 1 and 8, the same reference numerals as FIG. 2 respectively denote identical or equivalent elements. The upper case 2 and the lower case 3 are combined with each other so that the upper case 2 may cover the lower case 3, and they are joined with each other by means of a plurality of fastening screws 13 (only one of which is illustrated). A boss 14 is formed in the lower case 3, and the board 15 is fixed on the boss 14. An LED display circuit 16 is provided on the board 15, and a front glass 17 is fitted in the upper case 2 in order that the displaying by the LEDs can be seen transparently therethrough from the outside.

The male coupler 4 having an outside sleeve (cylindrical body) 41 caused to penetrate the mounting hole 5 of the lower case 3 includes an inside sleeve 42 extended from the outer sleeve 41. The inner sleeve 42 has a flange 43 which overhangs to an outer circumference thereof, and the flange 43 has an out edge 45 in which an annular groove 44 is formed, whose side facing an inner surface of the lower case 3 is opened. A seal ring 18 is fitted in the annular groove 44. Work is facilitated if the male coupler 4 is combined with the lower case 3 in a state where the seal ring 18 has been beforehand fitted in and held by the annular groove 44.

The seal ring 18 has a thickness larger than a depth of the annular groove 44 in order to be allowed to have a clamping overlap width. Specifically, the seal ring 18 is mounted so as to have a portion protruding from the annular groove 44 (refer to FIGS. 4 and 5 for details). Then, the above fastening screws 6 are engaged with screw holes, which are formed in the flange 43, by being caused to penetrate from the outside of the lower case 3, and are screwed forward to the flange 43. As the fastening screws 6 are fed in, the flange 43 is pulled toward the inner surface of the lower case 3, and the seal ring 18 is pressed against the inner surface of the lower case 3.

By having the seal ring 18 pressed against the inner surface of the lower case 3 in this manner, an interstice between the male coupler 4 and the lower case 3 is tightly sealed, whereby infiltration of moisture from the mounting hole 5 into the meter box 1 is prevented.

An annular reinforcing rib 19 is provided, along an outer circumference of the flange 43, on the inner surface of the lower case 3, and a plurality of reinforcing ribs 20 extending outwardly from the male coupler 4 are provided on an outer surface of the lower case 3. This is because a relatively large force acts upon an area of the lower case 3 surrounding the through hole 4, due to insertion and extraction of a connector. Note that the reinforcing rib 19 on the inner surface functions not only as reinforcement but also as a protective wall which prevents moisture from infiltrating into an inside of the meter box 1, i.e., a circuit portion, in a case where, for example, the moisture infiltrates as the seal ring 18 is degraded and a tight-sealing level thereof is thereby deteriorated.

When the male coupler 6 is attached by means of the fastening screws 6, a tight-sealing level of the seal ring 18 depends on an amount of turning the fastening screws 6, that is, an amount of screwing them forward. Consequently, it is desirable that a guide for ensuring a consistent adequate tight-sealing level be beforehand determined. In the present embodiment, an amount by which the outside sleeve 41 of the male coupler 4 projects from the lower case 3 can be referred to as the guide. An amount by which the outside sleeve 41 projects from the lower case 3 when the seal ring 18 has been adequately clamped is experimentally obtained, and a mark for that amount is beforehand added on the outside sleeve 41. For example, as shown in FIG. 1, by making the outside sleeve 41 smaller in outer size in an end side thereof to provide a step 41 a thereon, a shape of this step 41 a is beforehand determined so that, when adequate clamping has been made, the step 41*a* corresponds to an outer surface 3*a* of the lower case 3, i.e., to a plane surrounding the mounting hole 5.

By adopting such a configuration as this, it suffices that a worker performs clamping work with the fastening screws 6 by paying attention only to whether the step 41*a* on the outer circumference of the outside sleeve 41 has corresponded to the outer surface 3*a* of the lower case 3. Accordingly, the work is facilitated, and also, a consistent tight-sealing level is ensured by different workers.

Note that the guide for the tight-sealing level is not limited to the step, but may be a line surrounding the outside sleeve 41, or may be set as a border between two colors with which the outside sleeve 41 is colored.

Figure 3:
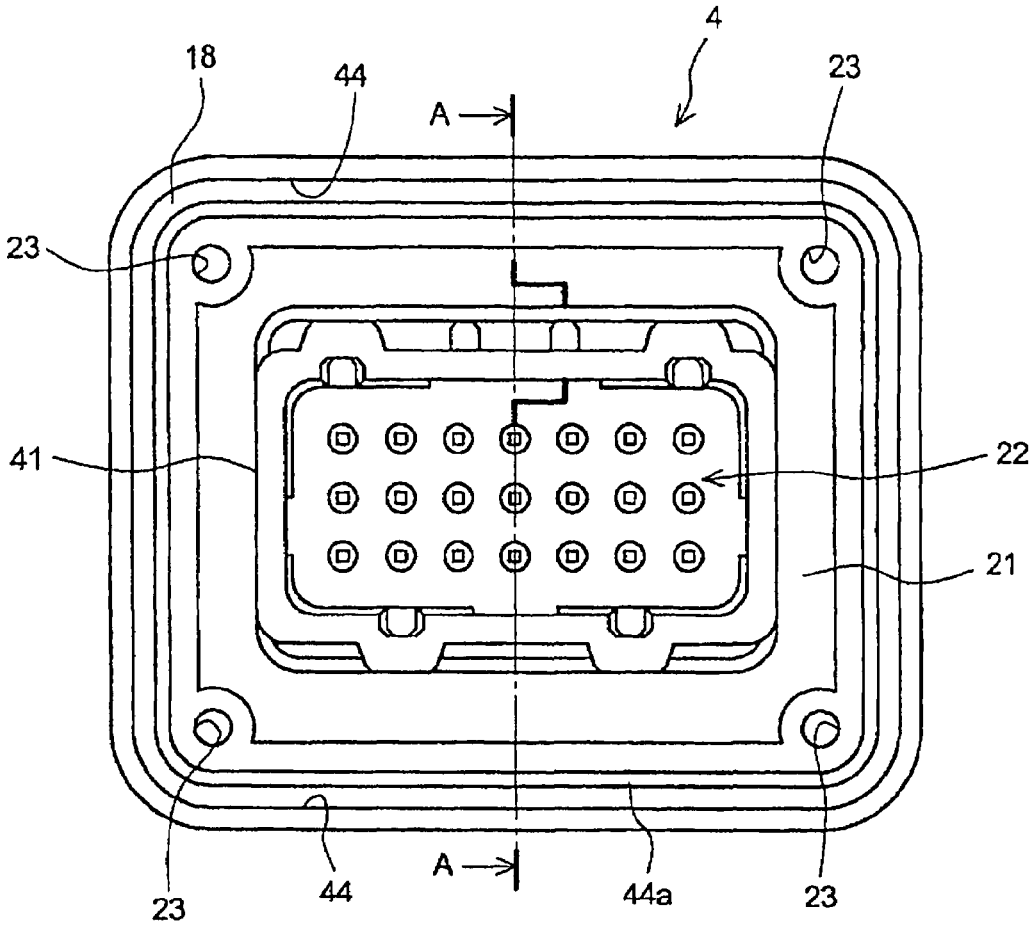
FIG. 3 is a front view of a coupler included in the meter for vehicle according to the embodiment of the present invention.
Figure 4:
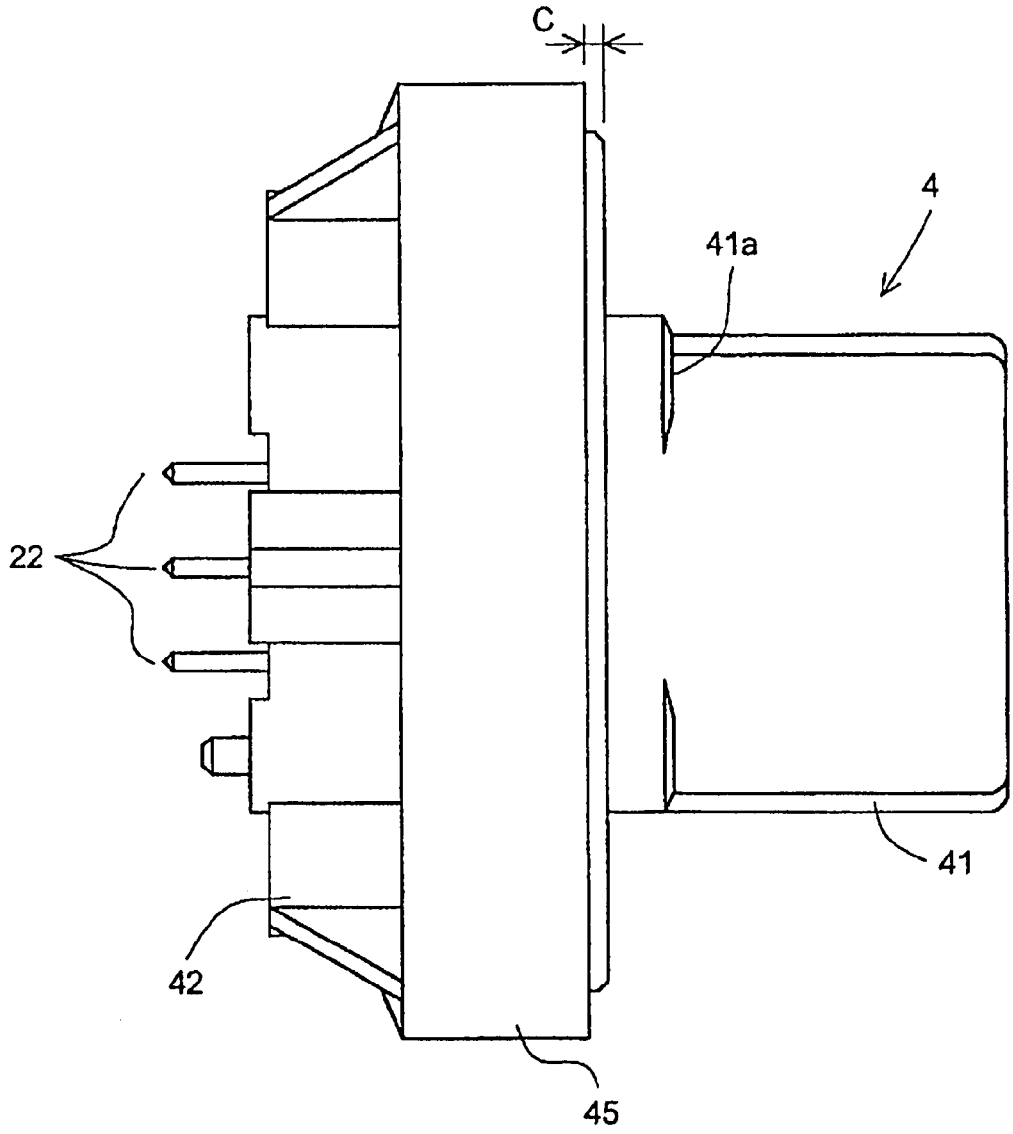
FIG. 4 is a side view of the coupler shown in FIG. 3.
Figure 5:
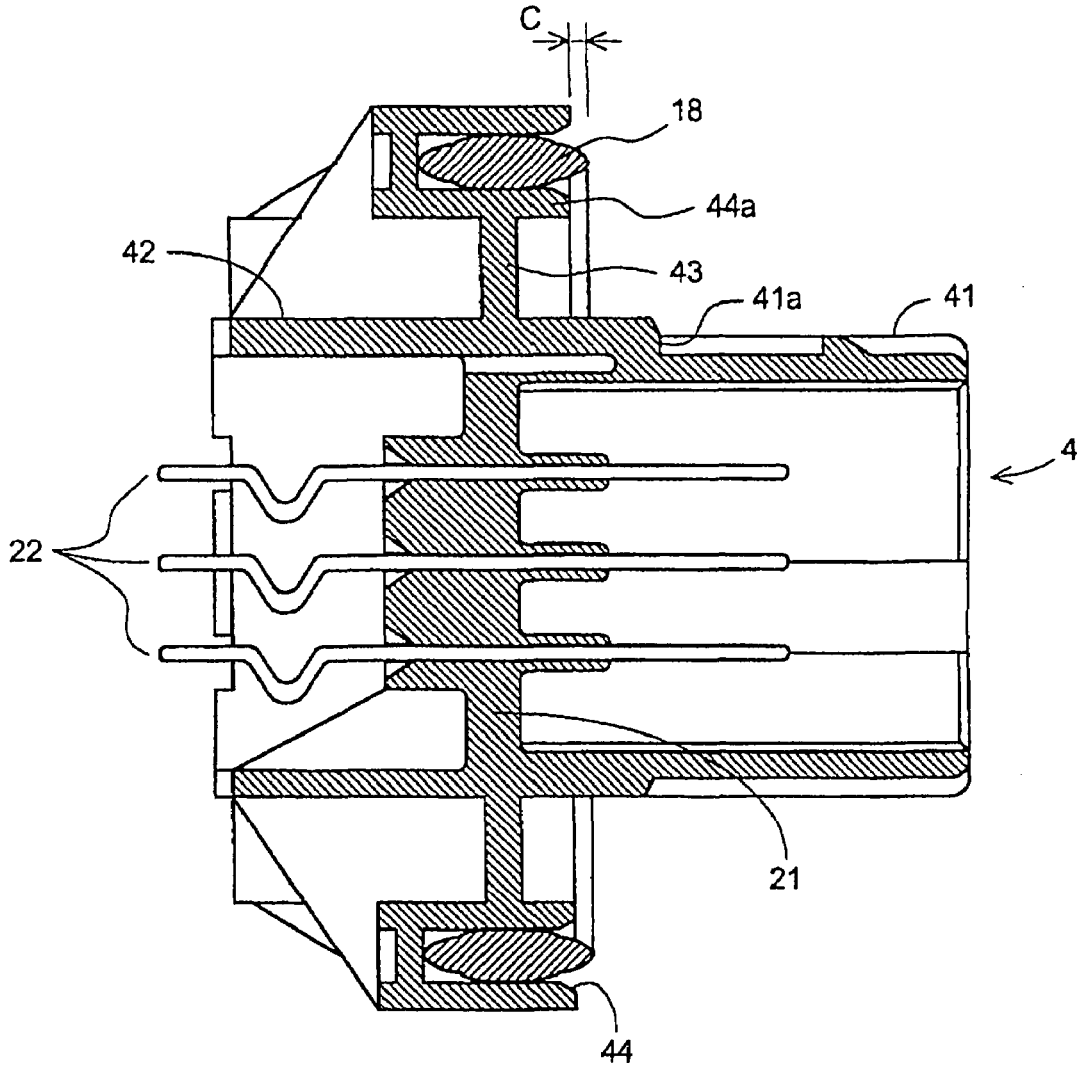
FIG. 5 is a cross sectional view shown in FIG. 3 taken along an A-A line thereof.

FIG. 3 is a front view of the male coupler 4, FIG. 4 is a side view of the same, and FIG. 5 is a cross sectional view taken along an A-A line of FIG. 3. In these drawings, an insulating wall 21 is provided between the outside sleeve 41 and the inside sleeve 42 of the male coupler 4, and a plurality of terminals 22 penetrate this insulating wall 21. The seal ring 18 is provided on an outermost circumference of the flange 43, and has a clamping overlap width C projecting from the annular groove 44 as shown in FIGS. 4 and 5. Fastening screw holes 23 into which the fastening screws 6 are inserted are provided in locations whose number is the same as the number of the fastening screws 6, i.e., four locations in an area further inward from one of walls forming the annular groove 44, i.e., an inner wall 44*a*. The fastening screw holes 23 have bottoms thereof closed, so that water infiltration through the fastening screw holes 23 is prevented. The step 41 is provided on the outside sleeve 41, and this step 41*a* becomes the above described "guide" in clamping the fastening screws 6.

Note that the male coupler 4 has been beforehand assembled to the board 15 when the meter for vehicle is mounted. By enabling the male coupler 4 to be mounted by means of the fastening screws 6 from the outside of the case after having done as described above, the following advantages arise.

As a function of a meter for vehicle, it is required that display elements, such as LEDs, provided on the board 15 are configured to be easily viewable, and to look good, from the outside transparently through the front glass 17. Accordingly, the board 15 has to be located in a predetermined position relative to the front glass 17. However, due to an allowance between the case and the board (including the male coupler 4), the board 15 does not always fall into a predetermined position after assembly. Consequently, correction of a position thereof becomes necessary, whereas it has been difficult to adjust the position of the board 15 after assembly with a conventional structure.

In the meter for vehicle of the present embodiment, the position of the board 15 is settled when the male coupler 4 is secured from the outside by use of the fastening screws 6. Accordingly, in the course of work of clamping the fastening screws 6, a fine adjustment of the position of the board 15 can be made along with an adjustment of the compression amount of the seal ring 18.

As has been described above, in the present embodiment, the adequate compression amount of the seal ring 18 obtained by clamping the fastening screws 6 can be judged based on whether or not the mark, i.e., the step, which is formed on the outer circumference of the male coupler 4 has been aligned with the outer surface of the lower case 3.

Note that, in the present embodiment, although the coupler is configured to be fixed by being clamped from an outside of the lower case by means of the clamping screws, the present invention can also be applied to a style in which the coupler is configured to be fixed by being clamped from an inside of the lower case by means of the clamping screws.

Additionally, although the present invention has been described by citing an example which is a meter for vehicle, it goes without saying that the present invention can be applied not only to meters for vehicle, but also broadly to control panel apparatuses in general each of which has a structure having an electric circuit inside thereof connected to the outside through an electric wiring, and each of which demands high waterproof performance and dustproof performance.

What is claimed is:

1. A control panel apparatus including a cabinet housing an electric circuit; and a coupler which is for connecting an electric wiring from the outside to the electric circuit, and which is composed of a sleeve and a flange, the sleeve penetrating a mounting hole provided in the cabinet, the flange overhanging from the sleeve in a direction along an outer circumference of the flange, the control panel apparatus comprising:

an elastic sealing member arranged between the flange and an inner surface of the cabinet;

fastening means which presses the flange against the inner surface of the cabinet; and a mark formed by an outer circumferential surface of the sleeve such that upon adequate compression of the elastic sealing member during fastening, the mark is advanced within the mounting hole until flush with an outer surface of the cabinet.

2. The control panel apparatus according to claim 1, wherein the mark is a step formed on the outer circumferential surface of the sleeve by varying a thickness of the sleeve.

3. The control panel apparatus according to claim 1, wherein the mark is a step formed on the outer circumferential surface of the sleeve by reducing a thickness of a portion of the sleeve extending beyond the plane of the outer surface of the cabinet.

4. The control panel apparatus according to claim 1, wherein the control panel apparatus is configured as a meter for vehicle.

5. The control panel apparatus according to claim 1, wherein an annular groove holding the elastic sealing member in the flange is formed in the flange.

6. The control panel apparatus according to claim 5, further comprising an annular member on the inner surface of the cabinet, the annular member being provided upright adjacently to an outer circumference of the flange of the sleeve.

7. The control panel apparatus according to claim 5, wherein the mark is a step formed on the outer circumferential surface of the sleeve by varying a thickness of the sleeve.

8. The control panel apparatus according to claim 5, wherein the control panel apparatus is configured as a meter for vehicle.

9. The control panel apparatus according to claim 1, further comprising an annular member on the inner surface of the cabinet, the annular member be provided upright adjacently to an outer circumference of the flange of the sleeve.

10. The control panel apparatus according to claim 9, wherein the mark is a step formed on the outer circumferential surface of the sleeve by varying a thickness of the sleeve.

11. A control panel apparatus including a cabinet housing an electric circuit; and a male coupler which is for connecting an electric wiring from the outside to the electric circuit, and which is composed of a sleeve and a flange, the sleeve penetrating a mounting hole provided in the cabinet, the flange overhanging from the sleeve in a direction along an outer circumference of the flange, the control panel apparatus comprising:

an elastic sealing member arranged between the flange and an inner surface of the cabinet;

fastening screws which press the flange against the inner surface of the cabinet; and a mark formed by an outer circumferential surface of the sleeve such that upon compression of the elastic sealing member to a predetermined value, the mark is advanced within the mounting hole until flush with an outer surface of the cabinet.

12. The control panel apparatus according to claim 11, wherein the mark is a step formed on the outer circumferential surface of the sleeve by varying a thickness of the sleeve.

13. The control panel apparatus according to claim 11, wherein the control panel apparatus is configured as a meter for vehicle.

14. The control panel apparatus according to claim 11, wherein an annular groove holding the elastic sealing member in the flange is formed in the flange.

15. The control panel apparatus according to claim 14, wherein the mark is a step formed on the outer circumferential surface of the sleeve by varying a thickness of the sleeve.

16. The control panel apparatus according to claim 14, wherein the control panel apparatus is configured as a meter for vehicle.

17. The control panel apparatus according to claim 11, further comprising an annular reinforcing rib on the inner surface of the cabinet, the annular member be provided upright adjacently to an outer circumference of the flange of the sleeve.

18. The control panel apparatus according to claim 17, wherein the mark is a step formed on the outer circumferential surface of the sleeve by varying a thickness of the sleeve.

19. The control panel apparatus according to claim 14, further comprising an annular reinforcing rib on the inner surface of the cabinet, the annular member being provided upright adjacently to an outer circumference of the flange of the sleeve.

20. The control panel apparatus according to claim 19, wherein the mark is a step formed on the outer circumferential surface of the sleeve by reducing a thickness of a portion of the sleeve extending beyond the plane of the outer surface of the cabinet.

* * * * *